US008896486B2

(12) United States Patent
Chiu et al.

(10) Patent No.: US 8,896,486 B2
(45) Date of Patent: Nov. 25, 2014

(54) MULTIBAND ANTENNA

(71) Applicant: Advanced-Connectek Inc., New Taipei (TW)

(72) Inventors: Tsung-Wen Chiu, New Taipei (TW); Fu-Ren Hsiao, New Taipei (TW); Po-Yuan Liao, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 13/940,281

(22) Filed: Jul. 12, 2013

(65) Prior Publication Data

US 2013/0307732 A1 Nov. 21, 2013

Related U.S. Application Data

(63) Continuation-in-part of application No. 12/825,080, filed on Jun. 28, 2010, now abandoned.

(30) Foreign Application Priority Data

Mar. 12, 2010 (TW) ..... 99107222 A

(51) Int. Cl.
*H01Q 1/38* (2006.01)

(52) U.S. Cl.
USPC ..... 343/700 MS

(58) Field of Classification Search
CPC ..... H01Q 1/38; H01Q 9/0407; H01Q 9/0421; H01Q 1/243; H01Q 5/0003
USPC ..... 343/700 MS, 702, 745, 795, 850
See application file for complete search history.

(56) References Cited

U.S. PATENT DOCUMENTS

| | | | | |
|---|---|---|---|---|
| 6,140,966 | A * | 10/2000 | Pankinaho | 343/700 MS |
| 6,204,819 | B1 * | 3/2001 | Hayes et al. | 343/702 |
| 6,639,555 | B1 * | 10/2003 | Kane et al. | 343/700 MS |
| 6,662,028 | B1 * | 12/2003 | Hayes et al. | 455/575.7 |
| 7,372,406 | B2 * | 5/2008 | Shiotsu et al. | 343/700 MS |

* cited by examiner

*Primary Examiner* — Hueund Mancuso
(74) *Attorney, Agent, or Firm* — Tracy M. Heims; Apex Juris, pllc

(57) ABSTRACT

A multiband antenna comprises a feeder member, a radiation conductor, a short-circuit member, a grounding plane and a feeder cable. The feeder member has a first coupling side. Two end of the short-circuit member are respectively connected with the radiation conductor and the grounding plane. The short-circuit member has a second coupling side parallel to and conformable to the first coupling side with a gap existing therebetween. The feeder cable has a central wire and an outer wire respectively connected with the feeder member and the grounding plane. The feeder member transmits a high-frequency fed-in signal to the short-circuit member in a capacitive coupling way. The multiband antenna of the present invention has a simplified antenna structure, a miniaturized size and wide frequency bands.

6 Claims, 3 Drawing Sheets

MULTIBAND ANTENNA

CROSS-REFERENCES TO RELATED APPLICATIONS

This application is a continuation-in-part patent application of U.S. application Ser. No. 12/825,080 filed in United States on Jun. 28, 2010, which itself claims priority under 35 U.S.C. §119(a) on Patent Application No(s). 099107222 filed in Taiwan, R.O.C. on Mar. 12, 2010, the entire contents of which are hereby incorporated by reference.

BACKGROUND OF THE INVENTION

1. Field of the Invention

The present invention relates to a multiband antenna, particularly to a radiation conductor structure, wherein the high-frequency fed-in signal is directly coupled to the short-circuit member.

2. Description of the Related Art

Wireless communication products have been extensively popularized, and the related components are also growing more and more sophisticated. Particularly, the size and transmission performance of the antenna usually influence the sales volume of the product. How to integrate the transmission functions of multiple frequency bands into a limited accommodation space has become a critical technology for the manufacturers and researchers.

The conventional multiband antenna usually integrates at least two different antennae. A U.S. Pat. No. 6,204,819 disclosed a "Convertible Loop/Inverted-F Antennas and Wireless Communicators Incorporating the Same", which is a dual-band antenna integrating an inverted-F antenna and a loop antenna, wherein a selecting switch feeds different signals into the two different antennae. However, the conventional dual-band antenna is a 3D structure bulky and hard to layout. Further, it needs a switching chip to operate band switching. Therefore, it has a complicated circuit structure and a higher the fabrication cost.

Another conventional multiband antenna technology, please refer to U.S. Pat. No. 7,372,406, disclosed a "Antenna Apparatus Including Inverted-F Antenna Having Variable Resonance Frequency", which is an inverted-F antenna having at least two antenna conductive elements coupled in series via at least one switch and/or at least one resonant circuit, and whereby multiband antenna can provide tuning of a resonance frequency with a wider frequency range. However, such antenna structure is not only bulky but also complicate, and further it is challenging and complex to assemble the smaller mobile apparatus.

Another conventional technology use an antenna structure having complicated shapes and diversified dimensions to achieve a multiband function. However, the designers are usually beset by the complicated shapes and dimensions of this type of antennae because they are hard to layout in a wireless communication product.

SUMMARY OF THE INVENTION

One objective of the present invention is to provide a multiband antenna, which comprises a feeder member, a short-circuit member, a radiation conductor, and a grounding plane. A feeder member has a receiver and a first side, wherein the receiver is configured to receive a signal from a feeder cable. A short-circuit member has a second side disposed across from the first side to form a specific gap. A radiation conductor is electrically connected to one end of the short-circuit member, wherein the radiation conductor is adapted to excite low-frequency resonant mode by the specific gap when the feeder member receives the signal. A grounding plane is electrically connected to another end of the short-circuit member.

The present invention uses the first side of the feeder member and the second side of the short-circuit member to form a transmission path of a high-frequency fed-in signal. The present invention obtains the standard frequency bands of the high-frequency and low-frequency systems via the transmission path. As to the standard frequency band of the low-frequency system, the radiation conductor is used to excite the low-frequency resonant mode of the antenna system. When the high-frequency signal of the feeder cable from the feeder member is coupled to the short-circuit member, the standard frequency band of the low-frequency system is generated. The short-circuit member has a serpentine path. The inductance can be adjusted via modifying the specific gap, width, and total length of the serpentine path and the low-frequency system can achieve a superior impedance matching of the antenna. Further, the capacitive reactance generated by the specific gap can implement the antenna to have superior impedance matching. Thereby, the antenna system has a great transmission frequency bandwidth and a reliable transmission quality.

As to the standard frequency band of the high-frequency system, the feeder member receives a high-frequency fed-in signal to excite a high-frequency resonant mode and generate the standard frequency band of the high-frequency system. Similarly, the inductance of the gap, width, and total length of the serpentine path can be adjusted to make the high-frequency system have superior impedance matching of antenna system.

Below, the embodiments are described in detail to make easily understood the technical contents of the present invention.

DESCRIPTION OF THE PREFERRED EMBODIMENT

In the following description, this invention will be explained with reference to embodiments thereof. However, these embodiments are not intended to limit this invention to any specific environment, applications or particular implementations described in these embodiments. Therefore, description of these embodiments is only provided for purpose of illustration but not to limit this invention. It should be appreciated that, in the following embodiments and the attached drawings, elements not related directly to this invention are omitted from depiction.

Figure 1:
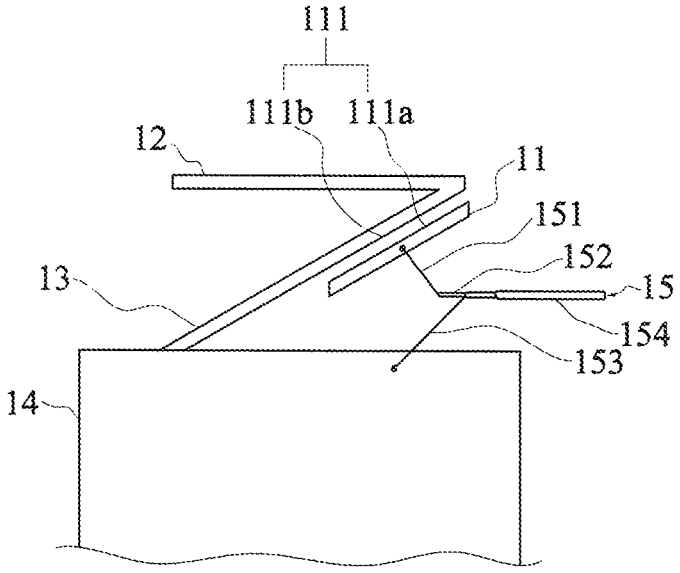
FIG. 1 is a top view of a multiband antenna according to a first embodiment of the present invention.

Refer to FIG. 1, which is a top view of a multiband antenna according to a first embodiment of the present invention. The multiband antenna of the present invention comprises a feeder member 11, a radiation conductor 12, a short-circuit member 13, and a grounding plane 14.

The feeder cable 15 has a central wire 151, an insulating layer 152, an outer wire 153 and a coating layer 154 from inside to outside. The central wire 151 is connected with the feeder member 11, and the outer wire 153 is electrically connected with the grounding plane 14. The insulating layer 152 is configured to insulate against electricity of the central wire 151. The coating layer 154 is configured to protect the inner wire from harm.

The feeder member 11 has a receiver (black point of the feeder member 11 in FIG. 1) and a first side 111*a*, wherein the receiver is configured to receive a signal from a feeder cable 15. The short-circuit member 13 has a second side 111*b* disposed across from the first side 111*a* to form a specific gap. A radiation conductor 12 is electrically connected to one end of the short-circuit member 13, wherein the radiation conductor 12 is adapted to excite low-frequency resonant mode by the specific gap when the feeder member 11 receives the signal. As shown in FIG. 1, the feeder member 11 does not contact with the radiation conductor 12, the short-circuit member 13 and the grounding plane 14.

More specifically, regarding standard frequency band of the low-frequency system, when a high-frequency fed-in signal is transmitted directly to the feeder member 11, an induced signal (not shown) will be generated on the short-circuit member 13 due to capacitive coupling effect of the specific gap, and then the radiation conductor 12 excites a low-frequency resonant mode, and whereby the multiband antenna has superior transmission frequency bands and a miniaturized size. A grounding plane 14 is electrically connected to another end of the short-circuit member 13. In this embodiment, a lateral side of the radiation conductor 12 is substantially parallel to a lateral side of the grounding plane 14.

Additionally, regarding the standard frequency band of the high-frequency system, the feeder member receives a high-frequency fed-in signal to excite a high-frequency resonant mode and generate the standard frequency band of the high-frequency system. Similarly, the inductance of the gap, width, and total length of the serpentine path can be adjusted to make the high-frequency system have superior impedance matching of antenna system.

In this embodiment, the short-circuit member 13 is designed to have a straight-line shape. More specifically, if the second side 111*b* of the short-circuit member 13 is a straight-line shape, the first side 111*a* of the feeder member 11 will be also a straight-line shape corresponding to form the straight-line shaped specific gap between the first side 111*a* and the second side 111*b*. For example, the feeder member 11 has a long straight-line shape with a length of about 30 mm and a width of about 3 mm. The radiation conductor 12 has a rectangular shape with a length of about 60 mm and a width of about 3 mm. The short-circuit member 13 has a parallelogram shape with a length of about 68 mm, an upper side of about 5 mm, a lower side of about 5 mm, and a height of about 42 mm.

As shown in FIG. 1, the feeder member 11 is arranged at the other side of the short-circuit member 13 corresponding to the radiation conductor 12, so as to avoid the influence between the signal from the feeder cable 15 and the signal transmitted via the radiation conductor 12 and the short-circuit member 13.

Figure 2:
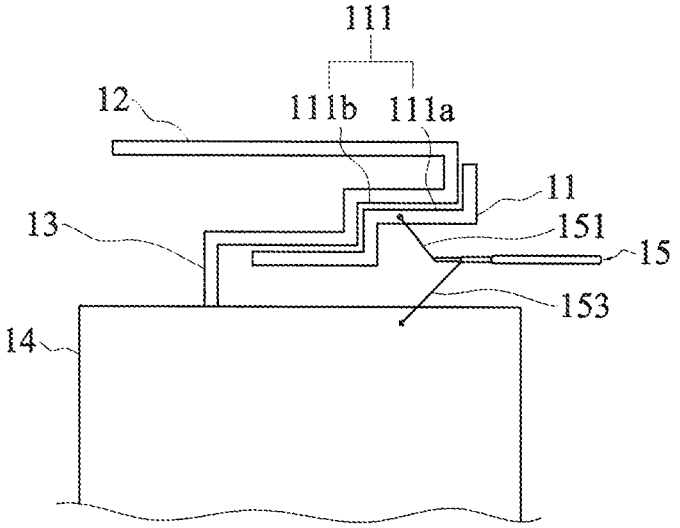
FIG. 2 is a top view of a multiband antenna according a second embodiment of the present invention.

Refer to FIG. 2, which is a top view of a multiband antenna according to a second embodiment of the present invention. The second embodiment is basically similar to the first embodiment except the feeder member 11 and the short-circuit member 13 have a stepped shape. In the second embodiment, the second side 111*b* of the short-circuit member 13 is a stepped shape, and the first side 111*a* of the feeder member 11 is also a stepped shape correspondingly to form the step-shaped specific gap between the first side 111*a* and the second side 111*b*. Similarly, when implementing the shape of the specific gap, the second side 111*b* of the short-circuit member 13 may be an arc, and the first side 111*a* of the feeder member 11 may be also an arc correspondingly to form the arc-shaped specific gap between the first side 111*a* and the second side 111*b*. Thus, the standard frequency bands of the high-frequency and low-frequency systems of the antenna system are generated. It is noted that, the aforementioned shapes are not intended to limit scope of this invention, and those of ordinary skill in the art shall appreciate that the shape of the specific gap may be substituted by any elements having an equivalent or similar function.

Figure 3:
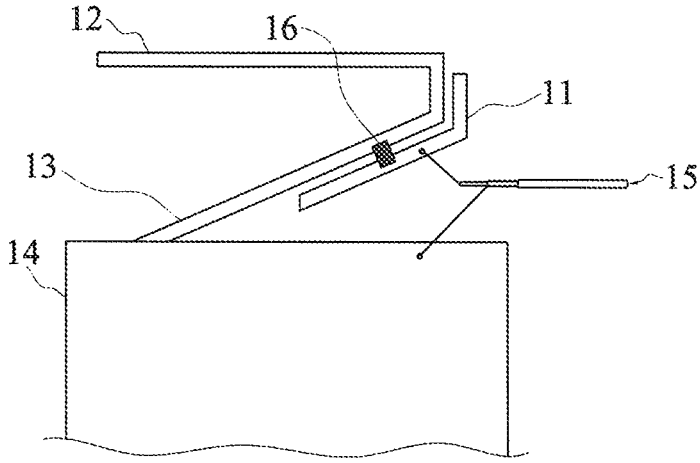
FIG. 3 is a top view of a multiband antenna according a third embodiment of the present invention.

Refer to FIG. 3, which is a top view of a multiband antenna according to a third embodiment of the present invention. The third embodiment is basically similar to the first embodiment except the specific gap is not formed by the first side 111*a* and the second side 111*b* but is realized by a chip capacitor 16. The chip capacitor 16 functions as a high-frequency signal coupling medium coupling signals from the feeder member 11 to the short-circuit member 13 to achieve a capacitive coupling transmission effect.

Figure 4:
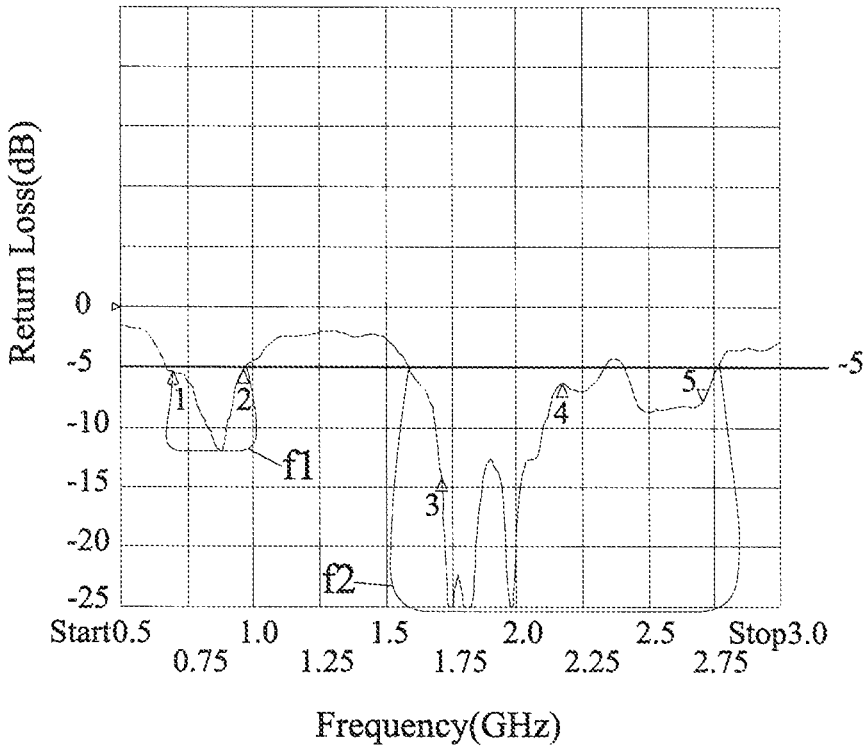
FIG. 4 is a diagram showing the measurement results of the return loss of the multiband antenna of the third embodiment.

Refer to FIG. 4, which is a diagram showing the measurement results of the return loss of the multiband antenna of the third embodiment, wherein the abscissa denotes the frequency and the ordinate denotes the dB value. When bandwidths of the antenna system are defined by a return loss of over 5 dB, the operation frequency of bandwidth f1 is between 698 and 960 MHz, which covers the LTE and AMPS systems. The operation frequency of bandwidth f2 is between 1710 and 2700 MHz, which covers the DCS and WCDMA systems. From the measurement results, it is known that the present invention indeed achieves the designed operational frequency bands.

Figure 5:
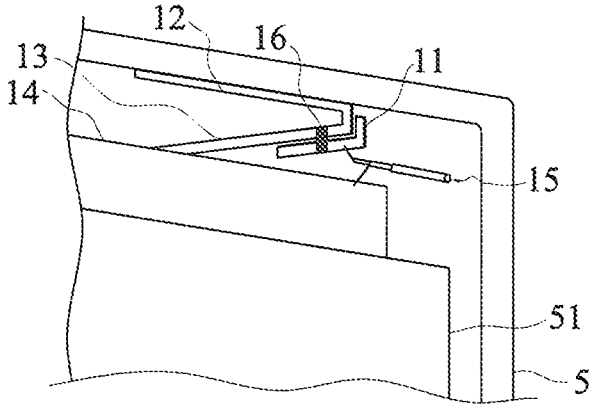
FIG. 5 is a partially-enlarged view schematically showing that the multiband antenna of the third embodiment is integrated with a portable computer.

Refer to FIG. 5, which is a partially-enlarged view schematically showing that the multiband antenna of the third embodiment is integrated with a portable computer. In assemblage, the antenna module is arranged in the edge of a panel 51 of a portable computer 5. As mentioned above, the chip capacitor 16 is arranged between the feeder member 11 and the short-circuit member 13 to replace the first side 111*a* and the second side 111*b*. Such a design can also achieve the capacitive coupling transmission effect.

In summary, the technical features of the present invention are in that: (1) the signal received by the feeder member 11 is coupled to the short-circuit member 13 such that the radiation conductor 12 can excite low-frequency resonant mode due to capacitive coupling effect of the specific gap, and the feeder member 11 can excite high-frequency resonant mode; (2) the energy of the transmitted signal can uniformly distributed on the short-circuit member 13; and (3) such the separated feeder member 11 and short-circuit member 13 can reduce interference from the feeder cable 15 carrying the signal when the high-frequency fed-in signal is fed to the feeder member 11. Therefore, the present invention is to provide the multiband antenna, which uses the feeder member 11 to transmit the high-frequency fed-in signal to a short-circuit member 13 via capacitive coupling, wherein the specific gap generates a capacitive reactance that makes the high-frequency and low-frequency systems of the antenna have superior impedance matching. In addition, the serpentine design of the short-circuit member 13 can effectively shorten the extension path of the radiation conductor 12 and modify the inductance to adjust the impedance matching of the antenna, whereby the multiband antenna has a great transmission frequency bandwidth and a reliable transmission quality.

The present invention indeed possesses utility, novelty and non-obviousness and meets the condition for a patent. The embodiments described above are only to exemplify the present invention but not to limit the scope of the present invention. Therefore, any equivalent modification or variation according to the spirit of the present invention is to be also included within the scope of the present invention.

What is claimed is:

1. A multiband antenna, comprising:

a feeding member having a receiver and a first side, wherein the receiver is configured to receive a signal from a coaxial cable;

a short-circuit member having a second side disposed across from the first side to form a specific gap, wherein the short-circuit member is not physically connected to the feeding member and an induced signal is generated on the short-circuit member to excite a high-frequency resonant mode from the feeding member due to capacitive coupling effect of the specific gap by means of capacitance between the short-circuit member and the feeding member;

a radiation conductor, physically connected to one end of the short-circuit member, wherein the radiation conductor is adapted to excite a low-frequency resonant mode by the specific gap when the feeding member receives the signal; and a grounding plane physically connected to another end of the short-circuit member.

2. The multiband antenna as claimed in claim 1, wherein a lateral side of the radiation conductor is substantially parallel to a lateral side of the grounding plane.

3. The multiband antenna as claimed in claim 1, wherein the second side of the short-circuit member is a straight-line shape, and the first side of the feeding member is also a straight-line shape correspondingly to form the straight-line shaped specific gap between the first side and the second side.

4. The multiband antenna as claimed in claim 1, wherein the second side of the short-circuit member is a stepped shape, and the first side of the feeding member is also a stepped shape correspondingly to form the step-shaped specific gap between the first side and the second side.

5. The multiband antenna as claimed in claim 1, wherein the second side of the short-circuit member is an arc, and the first side of the feeding member is also an arc correspondingly to form the arc-shaped specific gap between the first side and the second side.

6. The multiband antenna as claimed in claim 1, wherein the specific gap can accommodate a chip capacitor.

* * * * *